US005428908A

United States Patent [19]

Kerfoot

[11] Patent Number: 5,428,908

[45] Date of Patent: Jul. 4, 1995

[54] APPARATUS AND METHOD FOR SUBSIDENCE DEEPENING

[76] Inventor: William B. Kerfoot, 49 Ransom Rd., Falmouth, Mass. 02540

[21] Appl. No.: 28,655

[22] Filed: Mar. 9, 1993

[51] Int. Cl.[6] ..... E02F 3/88

[52] U.S. Cl. ..... 37/323; 37/321; 37/320; 37/318

[58] Field of Search ..... 37/318, 320, 321, 322, 37/323, 317

[56] References Cited

U.S. PATENT DOCUMENTS

| | | | |
|---|---|---|---|
| 967,797 | 8/1910 | Lovett | 37/322 |
| 2,076,823 | 4/1937 | Newell | 37/322 |
| 3,311,414 | 3/1967 | Cannon, Sr. et al. . | |
| 3,611,595 | 10/1971 | DeKoning . | |
| 3,645,018 | 2/1972 | DeKoning et al. . | |
| 4,040,667 | 8/1977 | Tax et al. | 37/318 |
| 4,296,970 | 10/1981 | Hodges . | |
| 4,574,501 | 3/1986 | Sloan . | |
| 4,681,372 | 7/1987 | McClure | 37/321 X |
| 4,759,664 | 7/1988 | Deal | 37/317 |
| 4,797,067 | 1/1989 | Eller et al. | 37/320 X |
| 4,854,058 | 8/1989 | Sloan et al. | 37/318 |
| 4,991,321 | 2/1991 | Artzberger | 37/323 X |
| 5,083,386 | 1/1992 | Sloan . | |
| 5,150,986 | 9/1992 | Rohr . | |

*Primary Examiner*—Randolph A. Reese
*Assistant Examiner*—Spencer Warnick
*Attorney, Agent, or Firm*—Thomas A. Kahrl

[57] ABSTRACT

A method of hydraulic dredging employing apparatus and a procedure for subsidence dredging for subsurface removal of sandy strata which results in subsidence, or drop in elevation of the bottom deposits of a body of water, wherein sand is mined laterally beneath the surface by a combination jetting/siphoning device and is transported from the site of dredging by pipeline apparatus connected to pumping apparatus to an adjacent beach location; and wherein the procedure employs removal of hydraulic pressure which results in subsidence or sinking of the upper layer of marine deposits where the amount of subsidence is directly related to the subsurface quantity of material removed and the removed material is used for beach nourishment with minimal damage to shellfish or finfish inasmuch as the surface beneath the deposits are left intact.

13 Claims, 6 Drawing Sheets

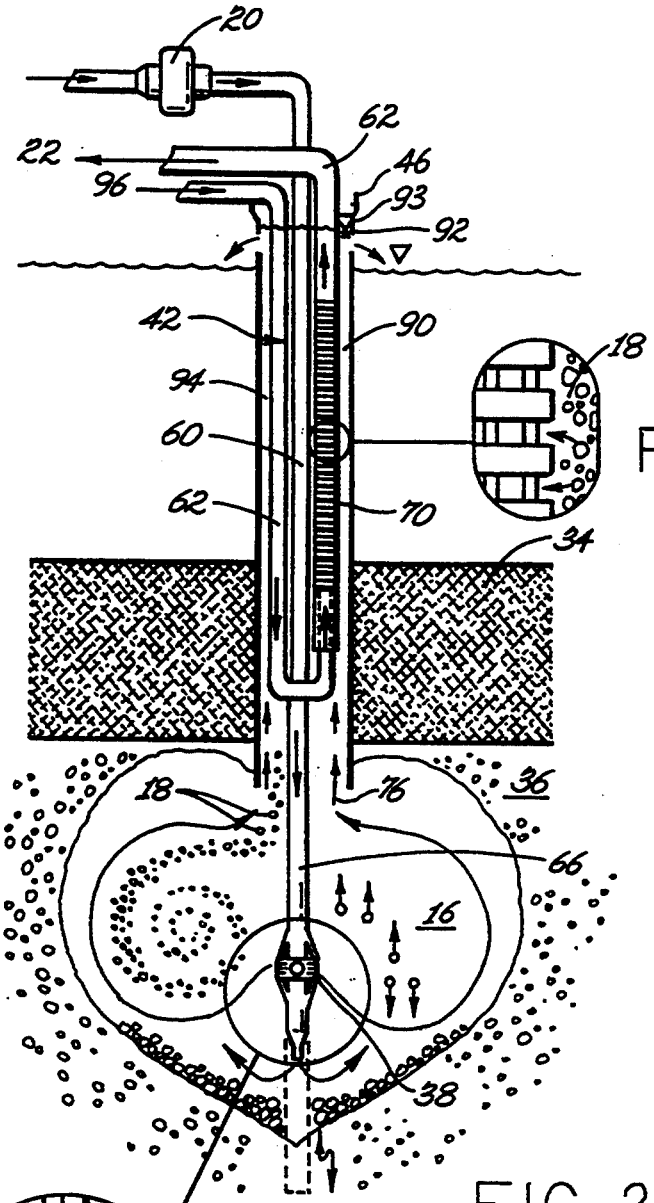
FIG. 2A
FIG. 2B
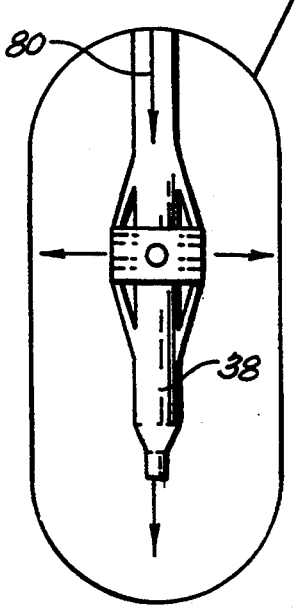
FIG. 2C

FIG. 6

| PARTICLE SIZE (MM) | STANDARD SIEVE OPENING | TERMINAL SETTLING VELOCITY (FT/SEC) | (CM/SEC) | DESCRIPTION |
|---|---|---|---|---|
| >2 | > 10 | 1.38 | 34.70 | Coarse sand/gravel |
| 2 - .9 | < 10 > 20 | .360 | 9.06 | Coarse sand |
| .9 - .36 | < 20 > 60 | .236 | 5.92 | Medium sand |
| .36 - .27 | < 60 > 80 | .109 | 2.73 | Medium sand |
| .27 - .13 | < 80 >120 | .048 | 1.20 | Fine sand |
| .13 - .10 | <120 >150 | .026 | .66 | Silt/fine sand |
| .10 - .08 | <150 >200 | .012 | .29 | Silt |

APPARATUS AND METHOD FOR SUBSIDENCE DEEPENING

BACKGROUND OF THE INVENTION

The invention relates to subsidence hydraulic dredging which provides an environmentally superior procedure, allowing deepening of bodies of water and shoreline regions without destroying shell-fish and removing surface sediments contained therein. In particular, subsidence dredging provides a method whereby the deeper sand layers under a body of water and coastal waters, particularly shoreline regions, can be winnowed and added to beach regions as "beach nourishment" thereby avoiding costly barging of silt sediments to approved disposal sites.

Applicant is aware of other prior art dredging procedures. One such procedure is disclosed in U.S. Pat. No. 3,645,018 to Dekoning et al., which discloses a suction pipe inserted into a layer of sand by way of a layer of clay, and a layer of water. Another prior art device is disclosed in U.S. Pat. No. 4,296,970 to Hodges, which discloses a hydraulic mining apparatus for operation in tar-like sand formation with a cutting jet nozzle. A further prior art device is disclosed by U.S. Pat. No. 3,645,018, to DeKonig et al., which discloses a method of measuring pressures in sand surrounding a suction pipe, the sand being covered by a layer of silt, wherein the sand may be dredged to the exclusion of the silt. DeKonig et al. is directed toward measuring the differences in specific gravities of the sand and the silt and for moving the lower end of the suction pipe so as to maintain it below the silt at all times during the suction dredging operation. While the above prior art devices show use of hydraulic mining apparatus having a cutting jet nozzle and the use of a suction pipe inserted into a layer of sand for underwater dredging, such prior art does not comprise the jetting and intake suction arrangements with screening for beach sand as it is employed in the Applicant's subsidence dredging method. Neither does the prior art show an associated seismic arrangement for determination of the extent of the mined cavity. Therefore the prior art is distinguishable. Furthermore, the prior art does not suggest the inventive combination of subsurface mining using a jetting intake for removing sand for glacial out wash deposits in combination with seismic devices to determine the extent of the subsidence dredging.

Accordingly, it is desirable to provide for a new and improved apparatus and method for subsidence dredging including hydraulic jetting and suction combined with hydraulic winnowing action for producing quality beach sand to provide an environmentally superior procedure for deepening shoreline regions without destroying shellfish and for replenishment/nourishment of the adjacent beach areas, which overcomes at least some of the disadvantages of the prior art.

SUMMARY OF THE INVENTION

This invention relates generally to a method for subsidence deepening and apparatus for subsurface hydraulic dredging and to depression of an underwater bottom surface by subsidence dredging.

More particularly, the invention is directed to a method and apparatus which generates subsidence deepening by hydraulic dredging and winnowing of a subsurface material which results in the subsidence (drop in elevation) of underwater bottom deposits. According to the present invention, sand is mined by combined jetting and suction hydraulic pumping action, by pumping beneath the surface, and transporting laterally from the site of deepening by pipe line to an adjacent beach area. The removal of hydraulic pressure by cessation of pumping results in subsidence (sinking) of upper layers of marine deposits on the bottom surface with the amount of subsidence being directly related to the subsurface quantity of material removed by the process. An advantage of the invention is that the subsurface bottom deposits, which are removed by pumping, are washed, segregated and winnowed out through a selective screen device such that clean sand of a preselected particle size distribution is removed and used for beach nourishment. The desired selected subsurface fraction of the bottom deposits are transported by pumping from the bottom deposit site by hydraulic pipe line, typically positioned extending from a pump apparatus located typically on a barge vessel positioned above the marine deposit.

During the process of removal by hydraulic dredging, sand removed from the bottom deposit site is washed and sorted, in situ, leaving gravel and fines behind with the result that an exceptionally high grade of sand is delivered to the selected beach site for replenishment. A further advantage of the present invention is that the method allows for deepening of regions of a bottom site which are contaminated by sediments (by organic or heavy metals) without transport of such sediments from the location adjacent the deposit site.

The invention includes both novel equipment necessary to perform the method of subsidence deepening as well as the method. The methods consist of five parts:

1.) A novel process for deepening channels for boat passage which minimizes disturbance of surface sediments and biota.
2.) A combined method of subsurface mining involving jetting and intake which produces an exceptional high quality of washed sand out of glacial out wash deposits which can be readily pumped to beach locations or transport vehicles.
3.) Equipment designed to allow continuous mining and in situ sorting of sand before transport to beach.
4.) The use of multiple overlapping cavities to create a uniform region of subsidence.
5.) The use of seismic devices to determine the extent of cavity (depth and diameter) during operation to define completion of subsurface removal prior to subsidence.

The success of subsidence deepening depends upon on-site physical conditions and appropriate equipment. Lake, pond or coastal bottom deposits, usually consisting of thick silt, must be underlain by thick sandy deposits. A geological coring is usually conducted to 25 ft. below original lake or coastal water bottom to determine the presence of suitable sands. Usually the surface silty bottom deposits are thick (5–15 ft.), which preclude normal dredge and beach disposal, however in the present invention a special pipe is hoisted into place and jetted into the underlying sandy deposit. This hoisting is done by a crane on a barge or by an "A"- frame. The platform should be equipped with two types of pumps (a) a jet pump and (b) a sand-sucker centrifugal pump. The pumps should be matched with a jet pump capable of an outflow equal to: $JP=SS+WL$
where JP=Jet pump capacity (gpm)

SS=Sand slurry pump output with pipe (gpm)

WL=Subsurface water loss (gpm) during recirculation through subsurface cavity boundary, usually, WL amounts to about 30% of flow down casing during jetting.

The percentage may vary depending upon the hydraulic conductivity of the subsurface sand layer. For example, for a 600 gpm discharge to beach the JP must operate at 780 gpm.

Usually a small circular silt curtain is placed around the pipe during jetting and slurry recovery. Any fines (silts or clays) which exit the pipe are caught and sedimented out in the immediate vicinity of the pipe. A series of pipes can be placed side-by-side in a line to allow a block or rectangular region of the bottom to drop.

Primitive jetting with a jet pipe within a casing was found to be unsatisfactory despite penetrating good medium sand for two reasons:

1.) Only during a brief period was production of sand efficient. As the diameter of the cavity increased, the sand size fraction transported out the pipe shifted from coarse fractions to fine fractions, eventually becoming clear water.

2.) The bottom of the cavity became coated with untransported gravel and cobblestones, stopping the mixing and injecting of the underlying fine and medium sands into the circulating water.

To overcome these obstacles, four modifications were made:

1.) Employ jet pump discharge and slurry pump return withdrawal to maintain high fixed velocity of recirculation and entry velocity into vertical pipe;

2.) Oscillate the jet pump discharge physically below the gravel layer and up into the cavity at 5–10 minute intervals to allow a continual re-injection of sand into the circulating water;

3.) Place an intake screen of wrapped stainless steel 50–200 slot size (0.05 to 0.2 inch) which rejects particles of larger size but permits the velocity-determined sand size range to easily pass through; and 4) Backwashing with a backwash water flow to the wrapped stainless steel screen allows self cleaning of the intake screen by removing shell pieces and gravel.

A small series of holes are made in the upper end of the casing to check the water level and allow visual adjustment of the slurry pump rate. The process of subsidence deepening proceeds as follows:

1.) Jet the pipe casing into place with top about two (2) feet above static water and bottom into sand layer to be mined.

2.) Allow jet to stir sand mixture to allow fine sand to exit small holes in the top of the casing.

3.) Start slurry pump withdrawal and adjust pumpage to maintain a 1 ft. head above static water.

4.) With properly sized casing, the sand will fluidize up into the vertical casing, the upwards movement of the particles matching the downward terminal settling velocities of fine, medium and coarse sand.

5.) The sand is then siphoned continuously into the intake to the slurry pump and pumped to the receiving beach.

A critical velocity range must be maintained during pumpage to achieve efficient continual siphoning of the sand mixture. The velocity inside the vertical casing usually follows a parabolic function with the maximum velocity at the center of the sides and lowering to about $\frac{1}{3}$ near the interface. This parabolic variation can be useful in maintaining a range of velocities, matched to the terminal setting velocities of sand (preferably medium), to suspend (fluidize) sand opposite the screen intake. If done properly, the product sand is ideal for beach replenishment, washed and sorted far better than natures normal processes.

The invention employs seismic instruments for monitoring bottom subsidence. Seismic amplitude cross-sections with density graph readout can depict the creation and collapse of subsurface cavities. Chirped or pinger seismic sources from 2 to 40 KHz amplitude penetrate up to 50 feet into bottom sediments to distinguish sand from silt and clay deposits (Caulfield, 1991). By moving the probe downward and into the top of the muck layer, the rebound echo from water/sediment interface can be removed. The resulting changes in density reflect the creation of a bubble of water within the underlying sediments. The breadth of the cavity can then be determined prior to collapse, which takes about 12 to 20 hours.

The probe is particularly useful when a number of pipes are run simultaneously. The cavity size needs to be uniform to drop a broad region evenly. Reference: Caulfield, E. 1991. SUBBOTTOM SITE CHARACTERIZATION BY ACOUSTIC IMPEDANCE. U.S. Army Corps of Engineers Waterways Experiment Station, USAE Waterways Experiment Station (WES), Vicksburg.

The invention further provides a method of subsidence deepening by subsurface hydraulic dredging to depress the surface of a bottom deposit. This includes the combined method of subsurface mining involving jetting and suction intake which produces a graded, washed sand output of glacial outwash deposits. The method includes the steps of selecting a bottom deposit site; installing a casing in the selected underwater bottom and underlying sand deposit; and providing a pumping apparatus for combined jetting and siphoning. The pumping apparatus includes a jet pump and a sand-sucker centrifugal pump wherein the operation of the pumps are matched with a jet pump capable of an outflow equal to JP, to produce a flow pattern for pumping a sand slurry having a graded beach sand quality wherein JP is defined by the formula:

JP=SS+WL where

JP=Jet pump capacity (gpm)

SS=Sand slurry pump output with pipe (gpm)

WL=Subsurface water loss (gpm) during recirculation through subsurface cavity boundary, usually, WL amounts to about 30% of flow down casing during jetting.

The percentage may vary depending upon the hydraulic conductivity of the subsurface sand layer. For example, for a 600 gpm discharge to beach the JP must operate at 780 gpm.

By pumping the jet pump discharge from an independent support while continuously sucking washed sand through the slotted slurry return by the slurry pump, the method provides for maintaining high fixed velocity of recirculation and entry velocity into the vertical pipe. Furthermore oscillating the jet pump below the gravel layer and up to the cavity at 5–10 minute intervals to allows a continual re-injection of sand into the circulating water, and placing a longitudinal winnowing water screen rejects particles of larger size but permits the velocity determined sand size range to easily pass through

BRIEF DESCRIPTION OF THE DRAWINGS

FIG. 2A An enlarged schematic cross section view of FIG. 1A, in cut-away, showing a jetting/siphoning apparatus of the invention of FIG. 1A.

FIG. 2B An enlarged view of the jetting/siphoning apparatus of the invention of FIG. 1A.

FIG. 6 A table of the relationship between particle size and settling velocity of particles showing silt, various grades of sand to coarse sand and gravel.

FIG. 9 An enlarged illustration of a seismic recorder mounted on a barge of FIG. 1A showing the operation of the seismic device measuring the size of a cavity created by subsidence deepening.

FIG. 10 An alternative embodiment of the casing configuration.

DETAILED DESCRIPTION OF THE PREFERRED EMBODIMENT

Figure 1A:
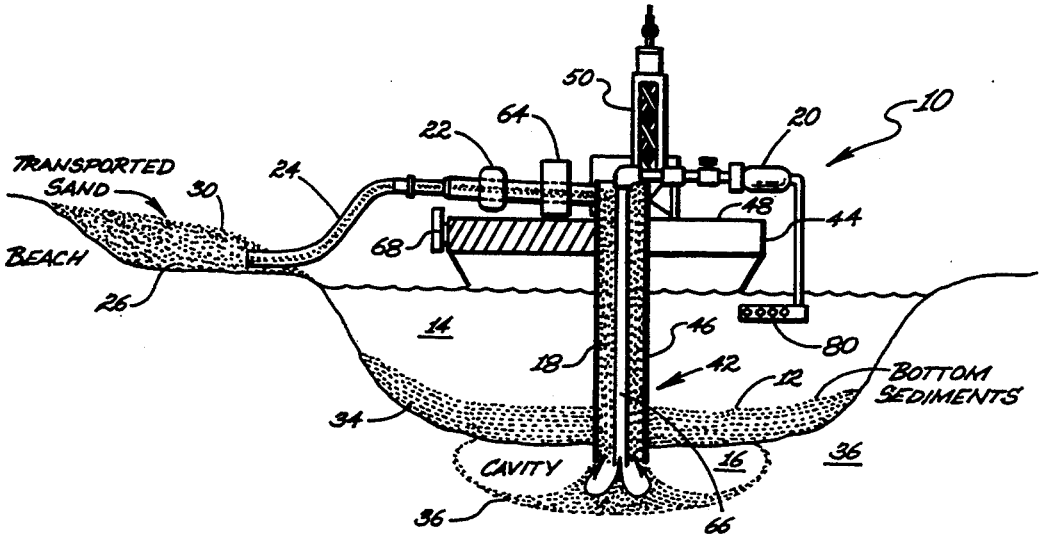
FIG. 1A diagrammatic representation of a first embodiment of subsidence dredging and associated apparatus for subsurface hydraulic dredging of an underwater area.

Referring to the drawings, FIG. 1A shows a combination subsidence hydraulic deepening apparatus (10) shown in place above bottom sediments (12) in a body of water (14) for producing a cavity (16) and pumping a slurry (18) of a mixture of sand and water by a plurality of pumps comprising a jet pump (20) and a slurry pump (22). The slurry is transported via a piping conduit (24) to an adjacent beach area (26), wherein the sand transported to the beach area (26) accumulates in a pile indicated as transported sand (30) for beach nourishment.

Figure 1B:
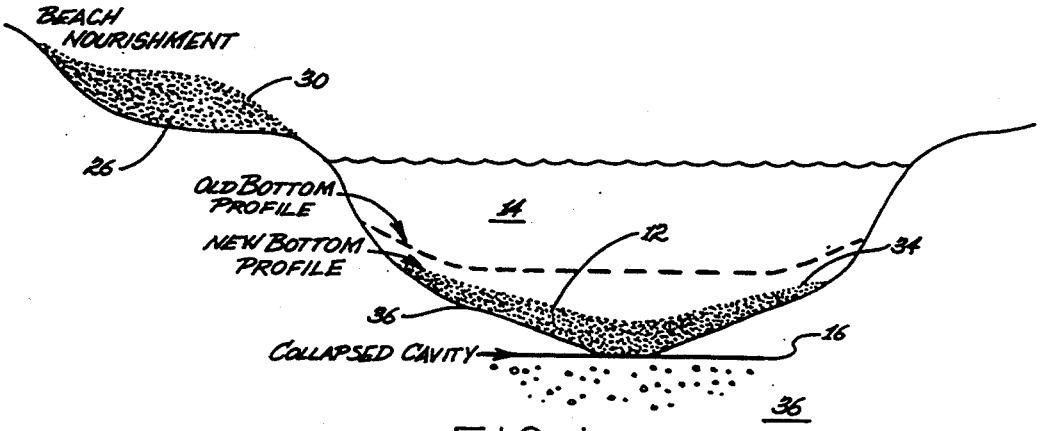
FIG. 1B A diagrammatic representation of the underwater area upon completion of subsidence deepening by the method of the present invention of FIG. 1A.
Figure 3:
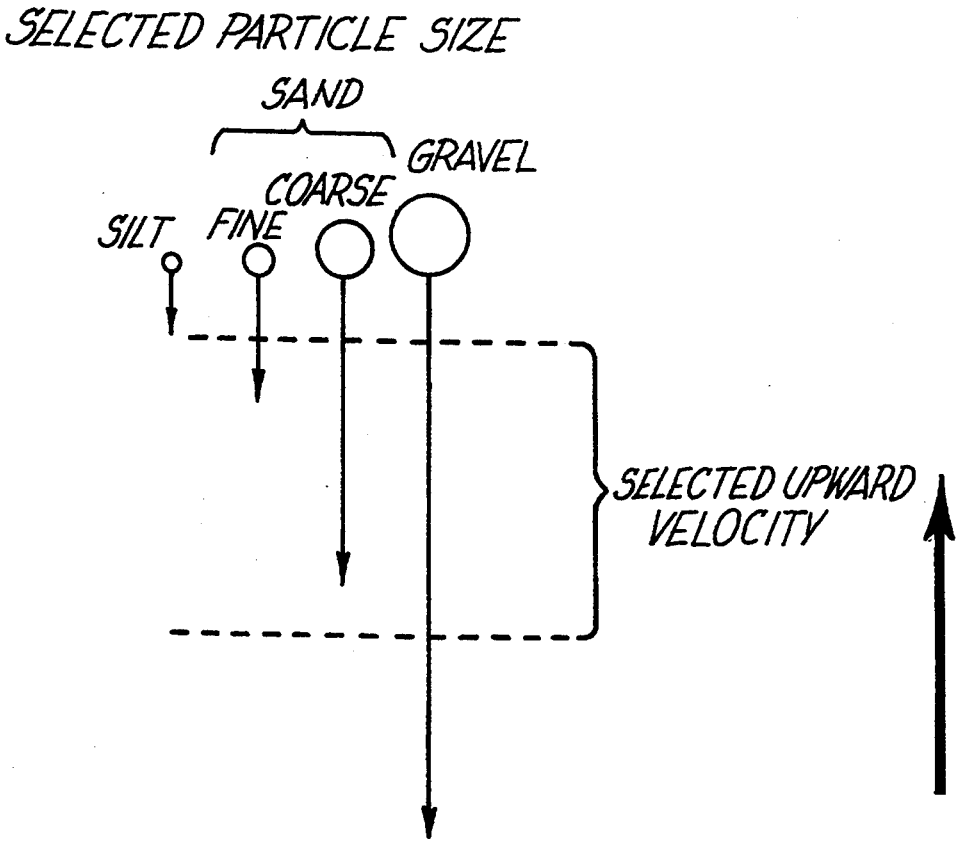
FIG. 3 A diagrammatic illustration of downward settling velocities offset by selecting a corresponding upwards velocity causing a stabilized layer of fine to coarse sand of the invention of FIG. 1A.
Figure 4:
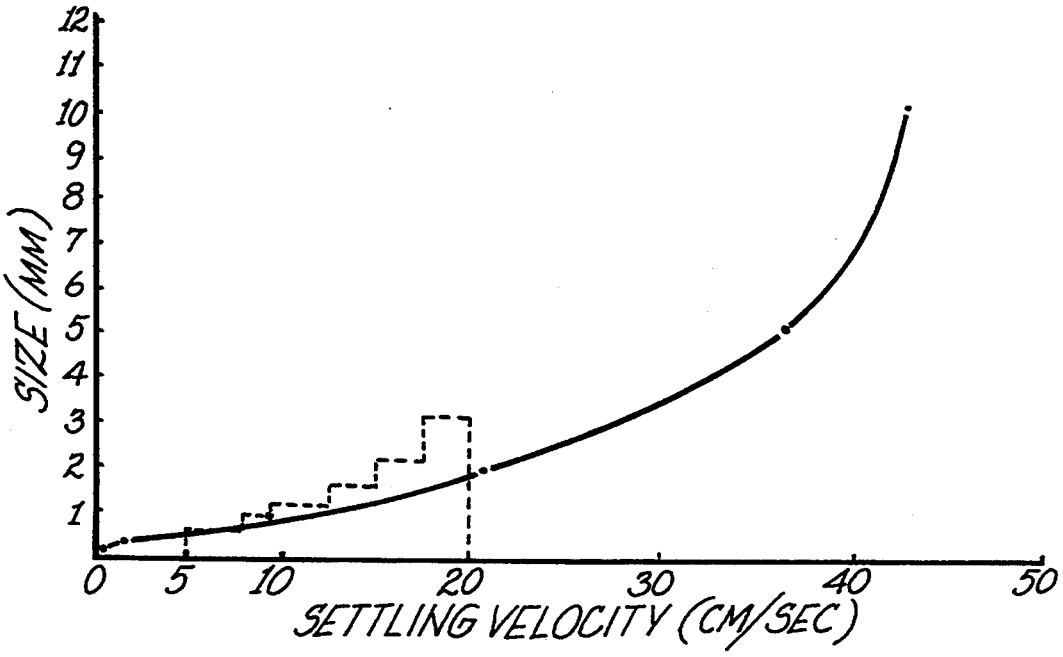
FIG. 4 A graphic illustration showing settling velocity as a function of size in millimeters, that is settling velocity in centimeter per second.

In the preferred embodiment, FIG. 1A shows the apparatus (10) in place over a selected area of the bottom of the body of water (14), the bottom being characterized by a layer of bottom sediments (12) and a layer of sand (36) whereby it is intended that the depth of the water in the body of water be increased by hydraulic dredging. With reference to FIG. 1B, the figure shows the body of water after the subsurface dredging operation is completed showing a pile of beach nourishment (30) on an adjacent beach (26) with the cavity (16) in the sand layer (36) collapsed and the bottom (12) having a new deepened profile wherein the layer of bottom sediments (12) has been lowered.

In the preferred embodiment, as shown in FIG. 1A, the subsidence deepening apparatus (10) comprises a plurality of pumps matched according to the selectively predetermined mathematical (JP=SS+WL) relationship for determining a size of sand particles to be selectively removed; said pumps comprising the jet pump (20) and the slurry pump (22), constructed as a sand-sucker centrifugal pump, mounted on a support device comprising a barge (44) for flotation and providing a support surface for said jet pump and sand-sucker pump over the selected bottom dredge site. The jet pump (20) includes an independently suspended jet pipe and nozzle, a flexible hose and a conventional water pressure gauge. The slurry pump (22) includes an intake flexible hose and suitable conventional pressure and sampling ports with hardened alloy steel to resist erosion from the suspended sands in the slurry.

The barge (44) is used to position a hollow casing (46) including a jetting/siphoning apparatus (42) in situ, said barge floating in the body of water (14) above the dredge site (47) comprises a platform (48). Hoisting equipment (50), such as a conventional "A" frame or crane, is mounted on said barge adapted for putting the various components of the subsidence hydraulic deepening apparatus (10) in place. Seismic apparatus (68) is also mounted thereon for measuring the amount of subsidence in the bottom sediment layer (34). The casing pipe (46) is configured with a preselected radius defined by a defined formula set forth below and is adapted to be lowered and sunk to the bottom sediment layer (34). A mathematical relationship of the critical pipe size can be depicted for quartz sand as:

$$\frac{Q}{\pi r^2} = V_s \text{ (2-20 cm/sec), hence}$$

$$r = (Q/\pi V_s)^{\frac{1}{2}} \text{ or } \sqrt{Q/\pi V_s}$$

Where:

r=radius of pipe q=slurry pump volume (cfm)

$\pi$=3.14, a constant $V_s$=mean terminal settling velocity of sand particles desired (ft./min)

For instance: If medium sand is desired, the terminal settling velocity of a 0.5 mm grain size is about 0.6 cm/sec or 0.25 ft./sec. For a 600 gpm (80 cubic feet/-min. or 1.33 cubic ft./sec) slurry pumpage, the ideal radius would be:

$$r_c=(Q/\pi V_s)^{\frac{1}{2}}=(1.33 \text{ cfs}/3.14\times 0.24 \text{ fs})^{\frac{1}{2}}=(1.77)^{\frac{1}{2}}1.33 \text{ ft}$$

For 300 gpm (40 cubic ft per minute or 0.66 cfs)

$$r_c=(0.66 \text{ cfs}/3.14\times 0.24 \text{ fs})^{\frac{1}{2}}=(0.66/0.75)^{\frac{1}{2}}=(0.88)^{\frac{1}{2}}=0.94 \text{ ft}$$

Figure 5:
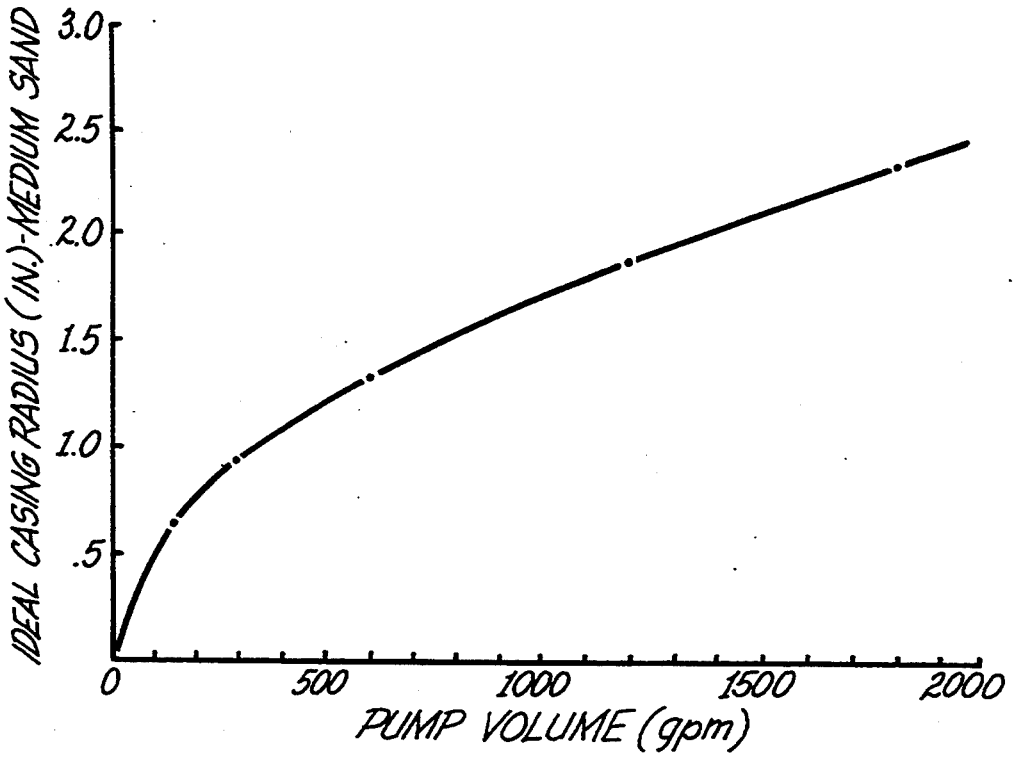
FIG. 5 A graph of the ideal radius of casing versus pump volume.
Figure 7:
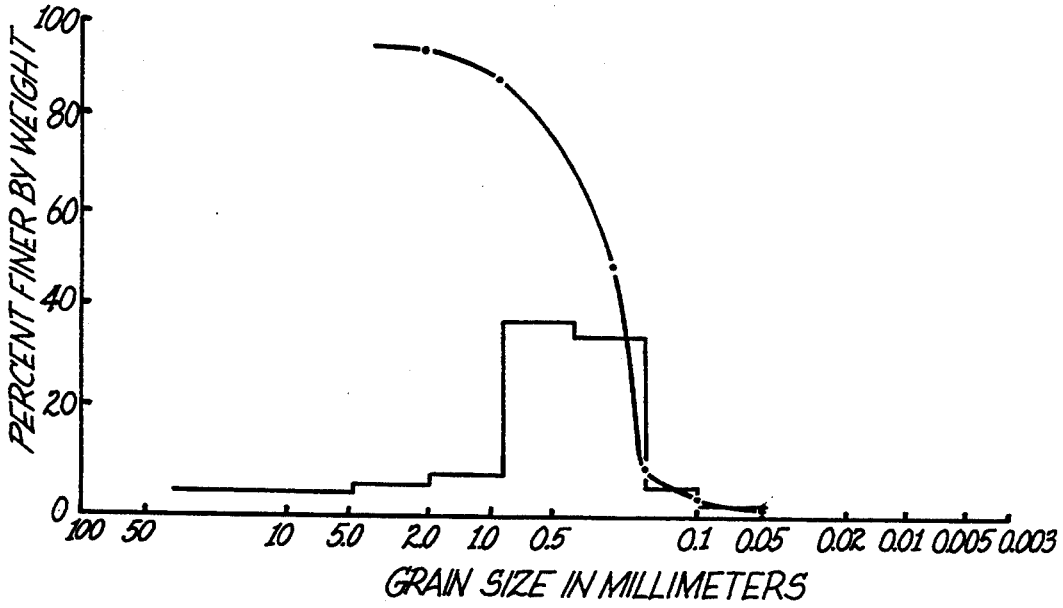
FIG. 7 A grain size distribution curve of laboratory samples taken at Surf Drive Beach sand, Falmouth, Mass., for medium sand, dated December, 1992.

FIG. 5 graphs the ideal radius of casing versus pump volume. The function is parabolic, suggesting that a 15 inch casing (7.5 inch radius) would be ideal for 200 gpm, a 4 ft. diameter (48 inch) would be desirable for a flow of 1400 gpm. Sediment is used to seal the sides of the casing for improved operation.

As is seen in FIG. 2A, the jetting/siphoning apparatus (42) comprises a continuous jetting nozzle (38) configured to oscillate into and out of the sand layer (36) thereby creating sufficient turbulence to supply a continuous re-injection of sand into circulating water in the cavity (16). The jetting/siphoning apparatus (42) further comprises jet piping (60) and slurry piping (62) adapted to be lowered into the operating position at the lower base of the casing (46). A pump drive (64), adapted for driving the particular size jet pump (20) and slurry pump (22), as shown in FIG. 1A, is mounted on the barge (44) for pumping water into the cavity (16) and for sucking sand slurry (18) out of said cavity into the conduit (24) for the transportation of sand of a pre-sorted quality, grade and size to the beach location (26).

The bottom of casing (46) is open at the base. The interior of the casing (46) includes a longitudinally extending water screen (70) adapted for segregating sand particles by winnowing action according to size. The slurry pump (22), sucks sand slurry into said casing through a water screen (70), whereby the layer of sand (36) is caused to continuously, laterally flow toward a casing inlet (76) and whereby the bottom layer (12) is caused to sink in an undisturbed state to a lower depth. The water screen (70) is a specifically-designed screen for ground water wells, normally keeping sand particles out while allowing water to flow through. In this application, the screen slot is oversized to allow sand through but to reject gravel. The V-slot design reduces particle clogging and permits easy backflushing to clear the intake area.

A source of water (80) is connected to the inlet of the jet pump (20), whereby water is jetted into the cavity (16) and slurry (18) is continuously sucked by the slurry pump (22) into a winnowing chamber (90) contained within the casing (46) and forced upwardly across the water screen (70) through said winnowing chamber and thence outwardly via slurry piping (62) to said slurry pump. As long as a head pressure above sea level is maintained (93), the casing and the apparatus are supported on the floating barge (44) serving as a platform for maintaining the subsidence deepening apparatus (10) constant position above the site (47). The bottom surface subsides due to the reduced pressure caused by cessation of the water head from the hydraulic dredging action.

Pumps (20) and (22) are connected to the jetting/-siphoning apparatus (42). The jet conduit 60, as shown in FIGS. 1A and 2 is disposed on the central axis of casing (46) and extends upwardly from the sand layer (36) and to above the surface of water 14. The siphoning conduit (94) is spaced from a second water discharge pipe (96) which is configured for backflushing. The water screen 70 installed on the slurry piping 62 is adapted for screening out large sand and gravel particles contained within the slurry 18 suspended in the casing. This allows for selective sorting of a particular size of sand and a sand and water slurry pipe.

In the preferred embodiment, the casing (46) is constructed of straight casing or corrugated casing and is designed to vary the turbulence and vertical velocity distribution to suspend different particle size distributions.

As shown in FIGS. 1A & 9, a seismic device (68) is mounted on the barge (44) by a suspending rod (58) having a transducer/receiver (74) extending into the water for determining the extent of the lowering of the bottom profile and the associated extent Of the collapsed cavity (16), including the depth and diameter of the collapsed cavity during the operation of the dredging. The seismic device consists of at least one recorder device.

GREEN POND LOCATION

Figure 8:
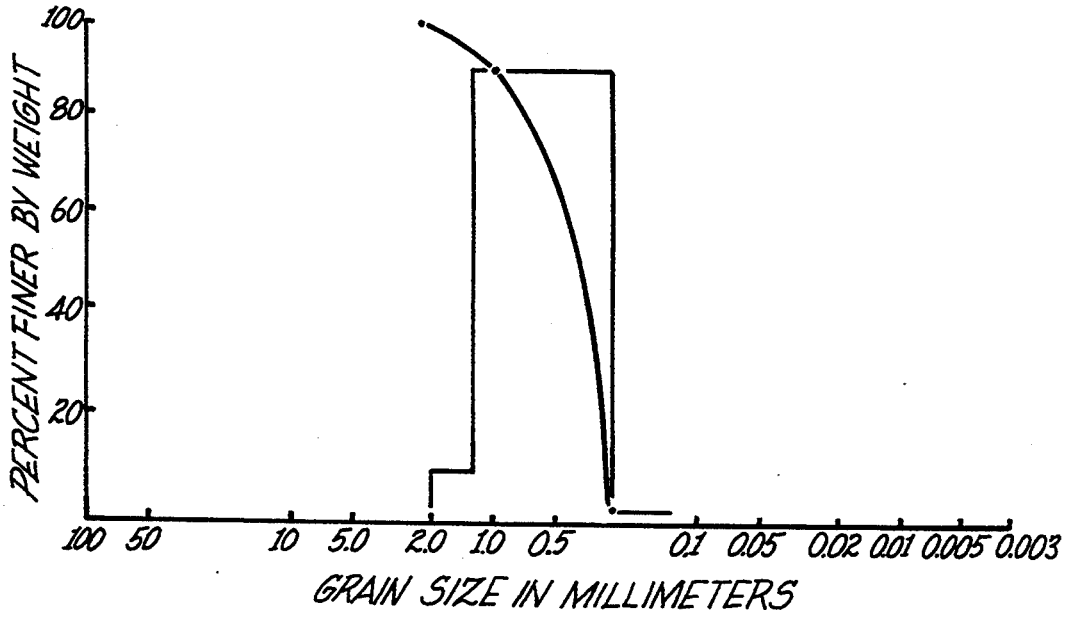
FIG. 8 A grain size distribution curve for samples taken at Green Pond, Falmouth, Mass. showing subsidence dredging discharge on beach area dated Nov. 20, 1992.

FIG. 8 illustrates a grain size distribution curve from actual experience. Subsidence dredging in Green Pond, Falmouth, Mass. for subsidence dredging discharge deposited on a beach area dated Nov. 20, 1992, that demonstrates grain-size distribution in millimeters from gravel to sand defines produced by the method of the invention.

In an alternate embodiment of the invention, a plurality of subsidence dredging devices can be placed side by side in a series or in a square to provide a block or rectangular dredged area.

The invention, as provided in the preferred embodiment, is adapted for providing continuous lateral mining of subsurface deposits. In particular, layers of sand deposits and an in situ sorting of sand by establishing a preset flow and by selecting a wall screen element for providing a winnowing effect for selectively sorting the sized grains of sand to be pumped.

What is claimed is:

1. An apparatus for deepening of an underwater area by forming a cavity in a selected subsurface layer of solid material beneath the bottom of a body of water comprising:

a) a support means for supporting the apparatus over a selected underwater area;

b) a jet pump means for pumping water through jet piping into the selected subsurface layer of solid material beneath the bottom of the body of water and for creating turbulence to suspend said solid material in a slurry;

c) a sand siphoning pump for siphoning slurry through sand siphoning piping from the underwater area to form a cavity, wherein said jet pump means and said sand siphoning pump are operationally matched for injecting water to form said slurry and for removal of said slurry from the subsurface layer;

d) a casing means positioned above the underwater area for developing an upward flow of the slurry, said casing means having a hollow winnowing chamber with a defined radius;

e) a winnowing means positioned, in communication with the sand siphoning piping, within the winnowing chamber for separating graded beach sand from gravel and silt deposits in the slurry;

f) conduit means for transferring the graded beach sand from the sand siphoning pump to an adjacent beach area for deposit; and g) sensing means for determining the extent of said cavity including depth and diameter during operation of the apparatus, said sensing means having at least one seismic device; whereby removal of hydraulic pressure created by said jet pump means results in increasing the depth of the body of water by subsidence of the bottom by an amount directly related to an amount of graded beach sand removed.

2. The apparatus of claim 1 in which the jet pump means has an out flow equal to JP=SS+WL where JP=jet pump capacity (gpm)

SS=sand siphoning pump output (gpm)

WL=subsurface water loss (gpm) during recirculation through subsurface cavity boundary amounting to approximately 30% of flow down the casing during jetting.

3. Apparatus according to claim 1 wherein the radius of the casing is defined by the formula $r_c=(Q/V_{s\pi})^{\frac{1}{2}}$ where $r_c$=ideal radius of pipe, Q=slurry pump volume (ft.$^3$/min.), $\pi$=3.14, a constant, and $V_s$=mean terminal settling velocity of sand particles desired (ft./min.).

4. The apparatus of claim 1 in which the jet piping comprises a continuous jetting nozzle configured to oscillate into and out of the solid material by way of hoist means mounted on the support means to create sufficient turbulence in the cavity.

5. The apparatus of claim 1 in which the jet piping is disposed along a central axis of the casing element and extends from the subsurface layer to above the surface of the body of water.

6. The apparatus of claim 1 wherein the winnowing means comprises a water screen which continuously winnows sand from the slurry.

7. The apparatus of claim 1 wherein the casing element is selected from a plurality of casing element configurations each designed to vary the vertical flow distribution to suspend different particle sizes.

8. The apparatus of claim 1 wherein the jet piping is independently suspended and is partly provided as flexible hosing, and wherein the jet pump means has a water pressure gauge.

9. The apparatus of claim 1 wherein the sand siphoning pump comprises an intake flexible hose connected to the sand siphoning piping and suitable pressure and sampling ports with hardened alloy steel to resist corrosion from the sand.

10. Apparatus according to claim 1 wherein the causing element is provided with a series of holes made in the upper end of the casing element to check the water level and to allow visual adjustment of the slurry pump rate.

11. The apparatus of claim 1 wherein the casing element is vertically positioned in place on the underwater area with the bottom of the casing element extending into the selected subsurface layer and a top of the casing element about two (2) feet above the surface of the body of water.

12. A method for operation of the apparatus of claim 1 comprising the steps of:

a) selecting an underwater area and locating the apparatus over the area;

b) matching the jet pump means and sand siphoning pump operation and providing the jet pump with an outflow, JP, equal to SS+WL, where SS=sand siphoning pump output and WL=subsurface water loss during recirculation through subsurface cavity boundary amounting to approximately 30% of flow down the casing element during operation;

c) providing the jet piping with a nozzle on the end to aid in creating the slurry in the subsurface layer;

d) operating the jet pump means to create the slurry and the sand siphoning pump to siphon the graded beach sand from the slurry through the winnowing means;

e) oscillate the jet piping and nozzle in the subsurface layer and cavity at 5–10 minute intervals to allow for sufficient turbulence to form to create the slurry.

13. The method of claim 12, further comprising the steps of transporting the graded beach sand laterally by way of the conduit means to the adjacent beach and stopping the operation of the jet pump means and sand siphoning pump to allow subsidence of the underwater area in direct proportion to an amount of material removed.

* * * * *